US009815649B1

(12) United States Patent
Jones et al.

(10) Patent No.: US 9,815,649 B1
(45) Date of Patent: Nov. 14, 2017

(54) DOOR-ACTUATED FEED ROLL SEPARATOR FOR AN IMAGING DEVICE

(71) Applicant: LEXMARK INTERNATIONAL, INC., Lexington, KY (US)

(72) Inventors: Philip David Jones, Lexington, KY (US); Robert Alan Pemberton, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/142,158

(22) Filed: Apr. 29, 2016

(51) Int. Cl.

| | |
|---|---|
| ***B65H 5/02*** | (2006.01) |
| ***B65H 5/04*** | (2006.01) |
| ***B65H 5/06*** | (2006.01) |
| ***G03G 15/00*** | (2006.01) |
| ***G03G 21/16*** | (2006.01) |

(52) U.S. Cl.
CPC ..... *B65H 5/062* (2013.01); *G03G 15/6552* (2013.01); *G03G 21/1633* (2013.01); *B65H 2301/44318* (2013.01); *B65H 2402/441* (2013.01); *B65H 2402/45* (2013.01); *B65H 2404/144* (2013.01); *B65H 2601/11* (2013.01); *B65H 2601/321* (2013.01); *B65H 2801/12* (2013.01)

(58) Field of Classification Search
CPC ..... B65H 5/062; B65H 2402/441; B65H 2402/45; B65H 2404/14; B65H 2404/144; B65H 2404/1442; B65H 2404/1451; B65H 2601/11; B65H 2601/321; G03G 21/1633
See application file for complete search history.

(56) References Cited

U.S. PATENT DOCUMENTS

| | | | | |
|---|---|---|---|---|
| 5,203,217 | A * | 4/1993 | Buckley | B41J 11/006 271/160 |
| 2006/0093397 | A1* | 5/2006 | Yamaoka | G03G 15/165 399/110 |
| 2013/0164066 | A1* | 6/2013 | Nakamura | G03G 21/1638 399/405 |
| 2014/0003825 | A1* | 1/2014 | Yamaguchi | G03G 15/55 399/9 |
| 2016/0340135 | A1* | 11/2016 | Lee | B65H 5/26 |

* cited by examiner

*Primary Examiner* — Prasad V Gokhale
(74) *Attorney, Agent, or Firm* — John Victor Pezdek

(57) ABSTRACT

An imaging device having a door-actuated feed roll separator mechanism. A pair of opposed panels of a frame of the imaging device are positioned parallel to a media path. A feed roll pair in the media path has a drive roll fixedly and rotatably mounted between the panels and a backup roll mounted to a pair of release assemblies that are slidably mounted to the panels. Biasing members bias the backup roll into contact with the drive roll forming a feed nip. A door pivotally mounted along a bottom end to the frame substantially covers the media path. A pair of tethers connect the pair of release assemblies to the door. With the door lowered, its weight applies a release force to the backup roll separating it from the drive roll to allow for easier removal of a media sheet jammed in the feed nip.

22 Claims, 11 Drawing Sheets

DOOR-ACTUATED FEED ROLL SEPARATOR FOR AN IMAGING DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

Field of the Invention

The field relates generally to media input feed systems for an imaging device, and, in particular, to devices for separating feed roll pairs to assist with media jam removal.

Description of the Related Art

Imaging devices such as electrophotographic printers employ a plurality of pairs of parallel rollers to feed and move media. The rollers may be constructed of rubber, rubber coated metal, metal, plastic or combinations of these materials. In each pair, one of the rollers, usually the drive roller, has a fixed position in the frame of the device while the mating roller, usually the backup or idler roll, generally has a spring or spring device applying defined amount of force to it to press the two rolls together. The drive and idler rolls form between them a linear area of rotary friction which is generally known as a "feed nip" or "nip" that allows media to move through the machine in a controlled manner.

During operation, media sometimes becomes jammed within the media path and must be removed by the user. The difficulty of the media removal process depends on the accessibility of the jam area and the degree to which the media has become trapped within the transport system. In prior art designs, the user was required to either pull the media through the machine overcoming the forces of the drive mechanism and springs or attempt to remove the trapped media by exploring through the available openings, sometimes resulting in the media being torn and only partially removed. Some printer embodiments contain a manually activated mechanism which the customer can activate, separating drive and idler roll and freeing the jammed media for easier removal. Successful use of this manual release mechanism depends on the user knowing it was there, knowing how to activate it and finally remembering to release the mechanism to close the feed nip in order for printing to continue. Another drawback with some prior art feed nip release mechanism is that should the release mechanism break, operation of the feed roll pair may be hampered or prevented due to the malfunction of the release mechanism.

It would be advantageous for a user to automatically be able to open the feed nip to clear a media jam and then have automatically close the feed nip without the use of a manually operated separator mechanisms. It would be further advantageous to allow for automatic opening of the feed nip without the need extra for additional motors or complicated release features. It would be still further advantageous that operation of the feed roll pair is not impaired in the event that the feed nip release mechanism breaks or malfunctions.

SUMMARY OF THE INVENTION

Disclosed is an imaging device having a door-actuated separator mechanism for a feed roll pair. The imaging device comprises a frame having a pair of opposed panels with the pair of opposed panels having a first and a second pair of opposed openings. The pair of opposed panels is positioned parallel to a media path and has mounted thereto a feed roll pair for transporting a media sheet along the media path. A door is pivotally mounted along a bottom edge thereof to the frame. The door has a raised closed position and a lowered open position. The door has a pair of opposed tether mounts provided on an inner surface thereof adjacent to a respective left and a respective right edge of the door and at a predetermined distance above the bottom edge the door. The door substantially covers the media path between the pair of opposed panels when in the closed position. The feed roll pair has a drive roll and a backup roll forming a feed nip therebetween. The ends of the drive roll are rotatably and fixedly mounted in a pair of opposed bushings mounted in the first pair of opposed opening. The ends of the backup roll extend through the second pair of opposed openings and are rotatably and fixedly mounted to the separator mechanism. The separator mechanism has a pair of opposed release assemblies mounted on respective exterior surfaces of the pair of opposed panels. The pair of opposed release assemblies each have a link, a foldable tether, and a spring. The link is slidably attached to a respective one of the pair of opposed panels. Each link has a first end and a second end with the first end of the link having a bushing mounted therein for receiving a respective end of the backup roll. The tether connects between the second end of respective link and a respective one of the pair of opposed tether mounts. The spring wraps around a portion of an outer circumference of the respective bushing mounted in the respective link. The springs of the opposed release assemblies apply respective biasing forces to the respective ends of the backup roll to press the backup roll into contact with the drive roll forming the feed nip. With the door lowered to an open position, the weight of the door applies a release force to the pair of opposed release assemblies via the respective tethers, sliding the links of the pair of opposed release assemblies and separating the backup roll from the drive roll. With the door in a raised closed position, the respective tethers are folded and no release force is applied by the door to the respective links.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

DETAILED DESCRIPTION

Figure 1:
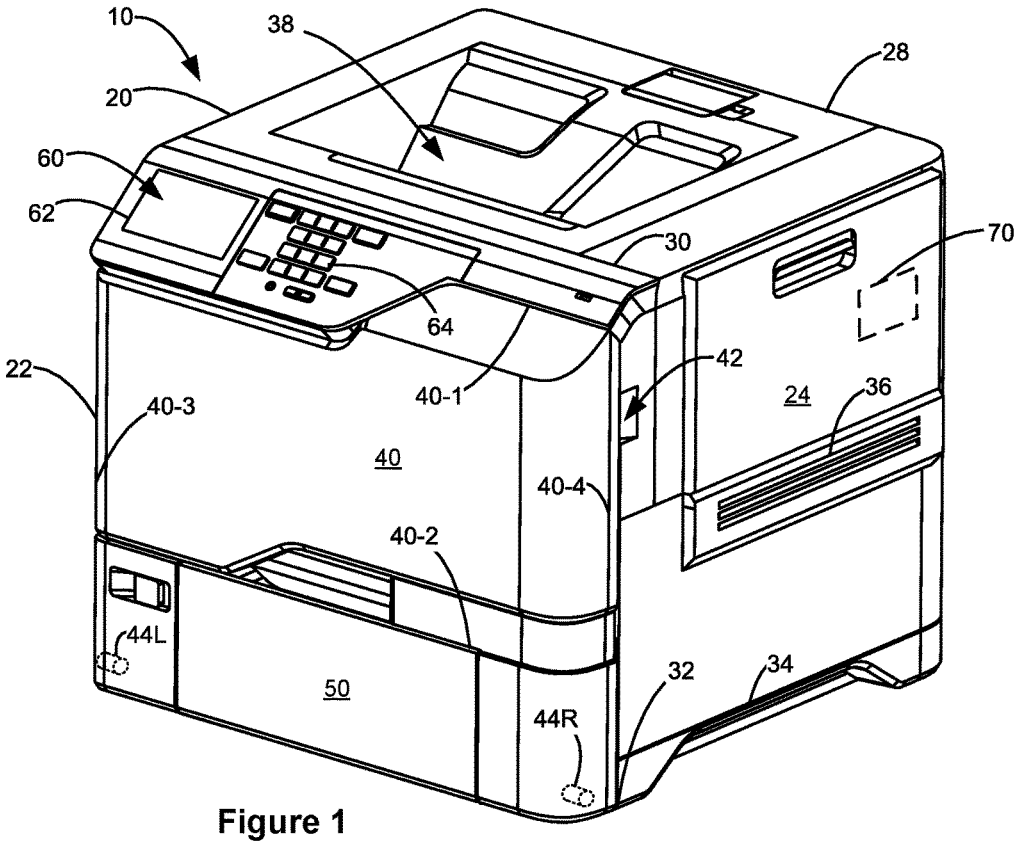
FIGS. 1-2 are perspective views of an imaging device having door-actuated feed roll separator of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including", "comprising", or "having" and variations thereof herein is meant to encompass the items listed thereafter and equivalents thereof as well as additional items.

Terms such as "about" and the like have a contextual meaning, are used to describe various characteristics of an object, and have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected", "coupled", and "mounted", and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left", "right", "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Relative positional terms may be used herein. For example, "superior" means that an element is above another element. Conversely "inferior" means that an element is below or beneath another element. Further, terms such as "first", "second", and the like, are also used to describe various elements, regions, sections, etc. and are also not intended to be limiting. Where possible, like terms refer to like elements throughout the description. A plurality of different structural components may be utilized to implement the media restraint of the present disclosure. Furthermore, and as described in subsequent paragraphs, the specific mechanical configurations illustrated in the drawings are intended to be example embodiments of the present disclosure and that other alternative mechanical configurations are possible.

"Media" or "media sheet" refers to a material that receives a printed image or, with a document to be scanned, a material containing a printed image. The media is said to move along a media path, a media branch, and a media path extension from an upstream location to a downstream location as it moves from the media trays to the output area of the imaging system. For a top feed option tray, the top of the option tray is downstream from the bottom of the option tray. Conversely, for a bottom feed option tray, the top of the option tray is upstream from the bottom of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the direction of the media path. The term "media length" refers to the dimension of the media that is aligned to the direction of the media path. "Media process direction" describes the movement of media within the imaging system, and is generally means from an input toward an output of the imaging device. The terms "front" "rear" "left" and "right" as used herein for the removable media tray and its components are with reference to the removable media tray being inserted in the imaging device as viewed in FIG. 1.

As used herein, the term "communication link" is used to generally refer to structure that facilitates electronic communication between multiple components, and may operate using wired or wireless technology. Communications among components may be done via a standard communication protocol, such as for example, universal serial bus (USB), Ethernet or IEEE 802.xx.

Figure 2:
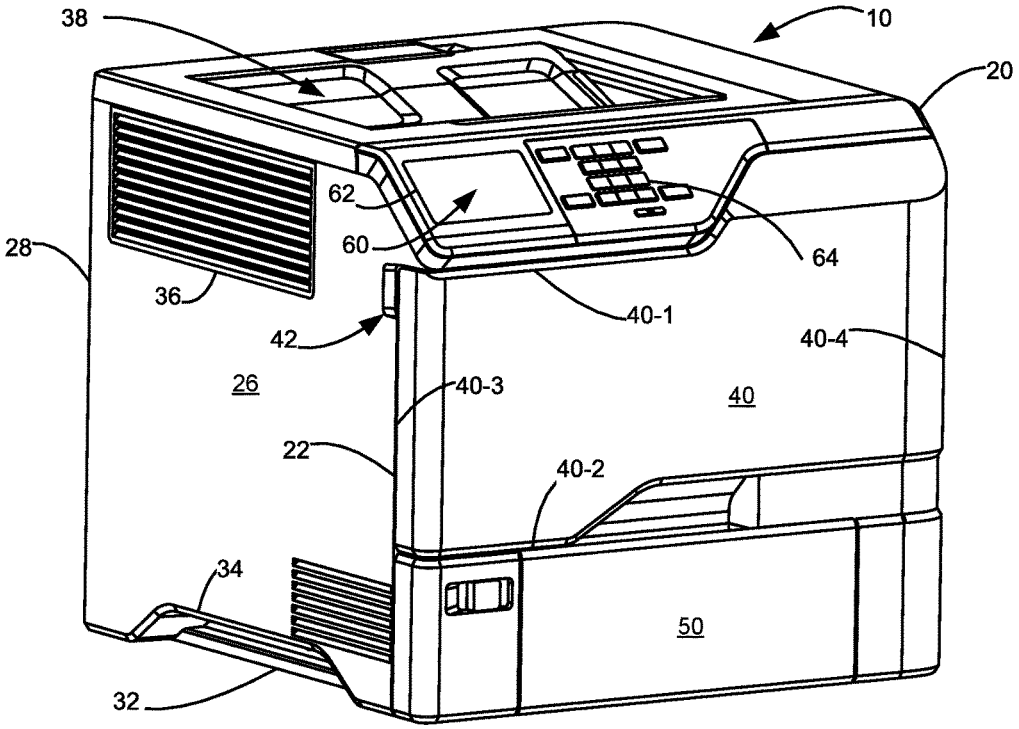
Figure 3:
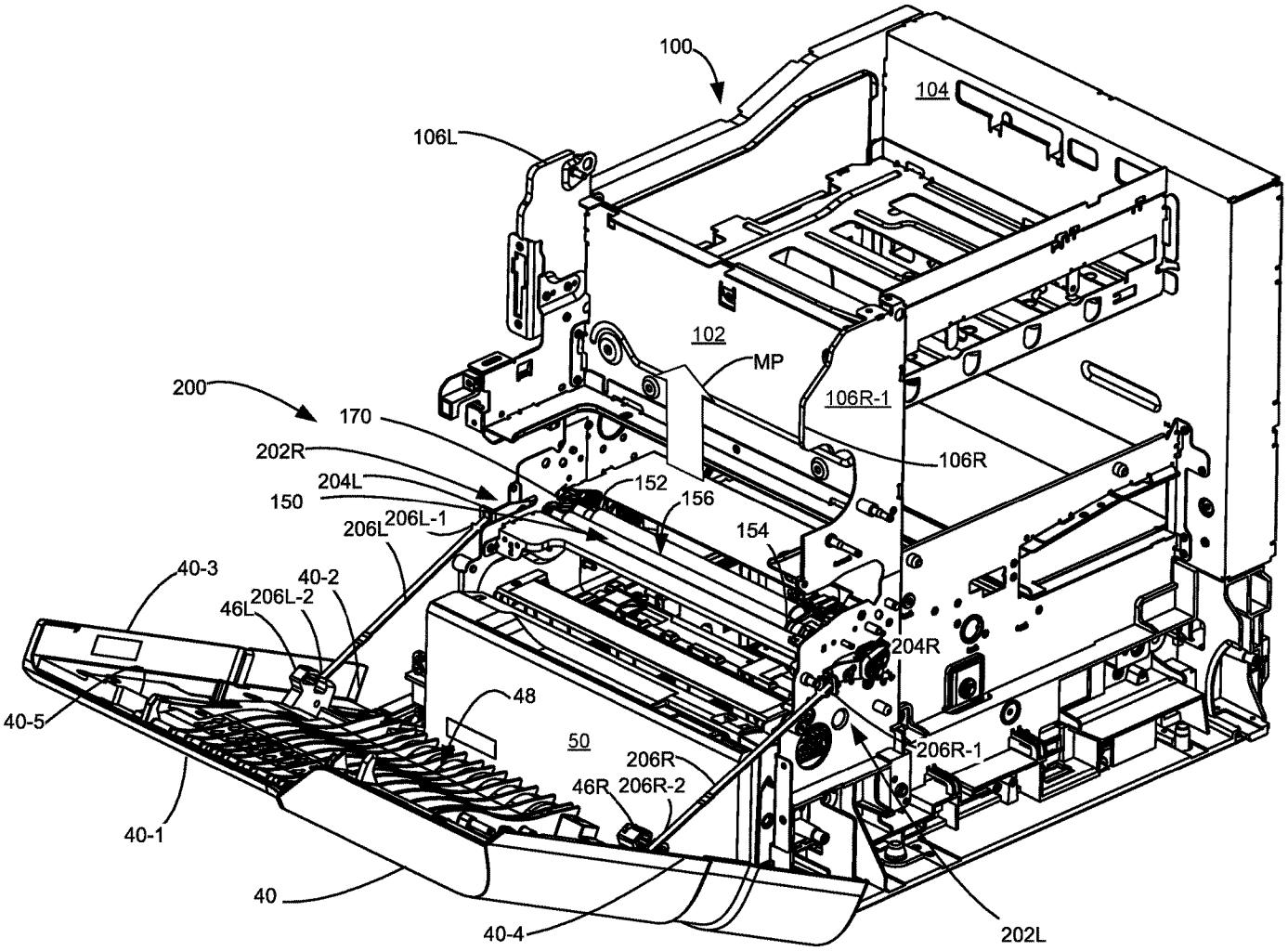
FIG. 3 is a perspective illustration of the imaging device of FIGS. 1-2 having the side and rear housing removed showing the interior frame having the door-actuated feed roll separator mounted therein with the front door lowered.

FIGS. 1-2 illustrate an example imaging device 10 having a housing 20 having a front 22, a first and second sides 24, 26, a rear 28, a top 30 and a bottom 32. Hand grips 34 are provided in several locations on housing 20 such as on sides 24, 26. Also, ventilation openings, such as vents 36 are provided on imaging device 10. A media output area 38 is provided in top 30 for printed media exiting imaging device 10. A door 40 is provided on the front 22 of imaging device 10. Door 40 has a top edge 40-1, a bottom edge 40-2, a left edge 40-3, and a right edge 40-4. Door releases 42 are provided on near top edge 40-1 at each side edge 40-3, 40-4 of door 40 and are used to open door 40 to allow user access into the interior of imaging device 10 for clearing media jam from the media path within imaging device 10. As shown in FIG. 2, door 40 is pivotally mounted on left and right pivot posts 44L, 44R provided adjacent to its bottom edge 40-2. In these figures door 40 is shown in a raised closed position while FIG. 3 shows door 40 in an opened lowered position. A removable media tray 50 for providing media to be printed is slidably inserted into imaging device 10 below door 40.

Controller 70 is mounted within imaging device 10 and is used to control operation of imaging device 10, including a drive motor used to rotate one or more feed roll pairs to convey media through imaging device 10, motors for a pick mechanism for feeding media sheets from the removable media tray 50, and imaging operations, such as printing. A user interface 60, comprising a display 62 and a key panel 64, may be located on the front 22 of housing 20. User interface 60 is in operable communication with controller 70. Using the user interface 60, a user is able to enter commands and generally control the operation of the imaging device 10. For example, the user may enter commands to switch modes (e.g., color mode, monochrome mode), view the number of images printed, take the imaging device 10 on/off line to perform periodic maintenance, and the like.

Controller 70 includes a processor unit and associated memory and may be formed as one or more Application Specific Integrated Circuits (ASICs). The associated memory may be, for example, random access memory (RAM), read only memory (ROM), and/or non-volatile RAM (NVRAM). Alternatively, the associated memory may be in the form of a separate electronic memory (e.g., RAM, ROM, and/or NVRAM), a hard drive, a CD or DVD drive, or any memory device convenient for use with the controller. Controller 70 may be illustrated in the figures as a single entity but it is understood that controller 70 may be implemented as any number of controllers, microcontrollers and/or processors.

Figure 7:
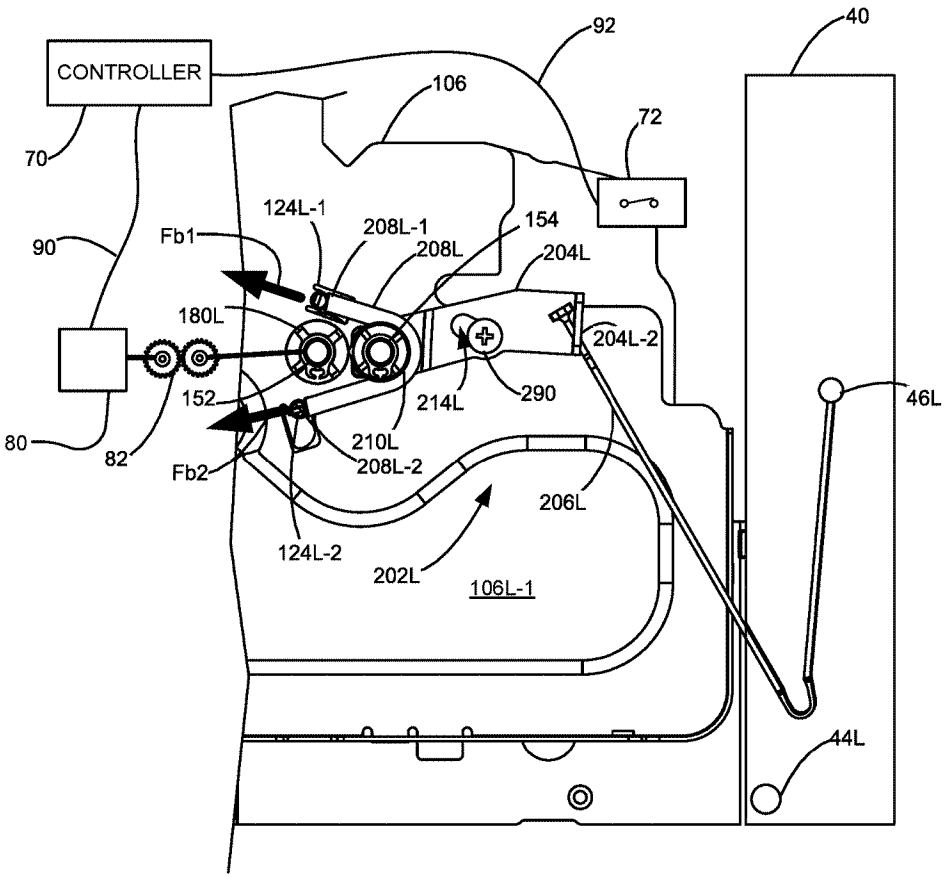
FIG. 7 is a left side elevational view for the door-actuated feed roll separator of FIG. 3 and attached feed roll pair shown with the door closed and the feed rolls in a media feeding state with a schematic representation of the feed roll drive system and door interlock switch.
Figure 8:
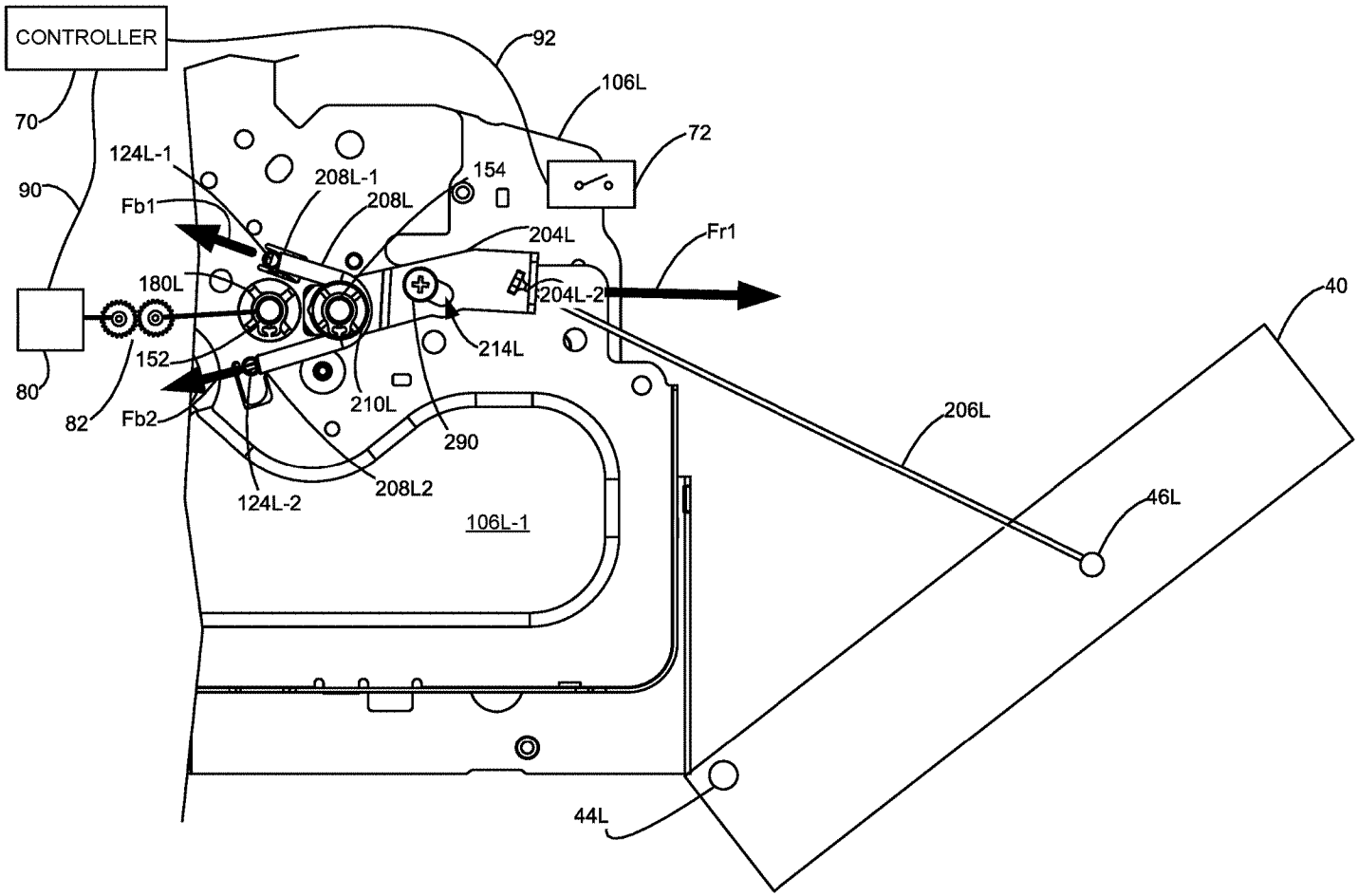
FIG. 8 is a left side elevational view for the door-actuated feed roll separator of FIG. 3 and attached feed roll pair shown with the door open and the feed rolls in a separate state with a schematic representation of the feed roll drive system and door interlock switch.

FIG. 3 illustrates imaging device 10 with its side and rear covers removed to show the door-actuated feed roll separator mechanism 200 of the present disclosure mounted to frame 100 of imaging device 10. Frame 100 has a front panel 102, a rear panel 104 interconnected by opposed side panels, shown as left and right side panels 106L, 106R. A media path MP, indicated by the arrow, is present between left and right side panels 106L. 106R. Mounted in media path MP is at least one feed roll pair 150 that is mounted to left and right side panels 106L, 106R as further described hereinafter. Feed roll pair 150 consists of a drive roll 152 and a backup roll 154. Drive roll 152 has a drive gear 170 mounted thereon that is driven by drive motor 80 and gear train 82 as schematically shown in FIGS. 7-8. Drive roll 152 is rotatably and fixedly mounted to left and right side panels 106L, 106R so that drive gear 170 remains engaged with gear train 82. Drive roll 152 and backup roll 154 form a feed nip 156 through which media is fed along media path MP. A plurality of parallel ribs 48 are provided on an inner surface 40-5 and serve as media guides along a duplex portion of the media path MP when door 40 is raised in the closed position.

In FIG. 3 separator mechanism 200 is shown in an actuated position with door 40 in its lowered open position. Separator mechanism 200 has a pair of opposed release assemblies, shown as left and right release assemblies 202L, 202R, that are respectively attached to the left and right ends of backup roll 154. Left and right release assemblies 202L, 202R include opposed or left and right links 204L, 204R, and left and right tethers 206L, 206R, respectively. Door 40 includes opposed tether mounts, shown as left and right tether mounts 46L, 46R on inner surface 40-5 at a predetermined distance above the bottom edge 40-2. A first end 206L-1 of tether 206L is connected to a link 204L slidably mounted on left side panel 106L while a second end 206L-2 is connected to a tether mount 46L. Similarly ends 206R-1, 206R-2 of tether 206R are connected to slidably mounted link 204R and tether mount 46R. Although it appears that backup roll is mounted directly to left and right side panels 106L, 106R, backup roll 154 is not and is instead mounted to left and right links 204L, 204R as detailed below. Backup roll 154 is free to translate with respect to drive roll 152 and both rolls 152, 154 are vertically located in frame 100 by two pairs of opposed openings consisting of left and right openings 120L, 120R and left and right openings 122L, 122R (see FIGS. 5-6) provided in left and right side panels 106L, 106R, respectively.

Figure 4:
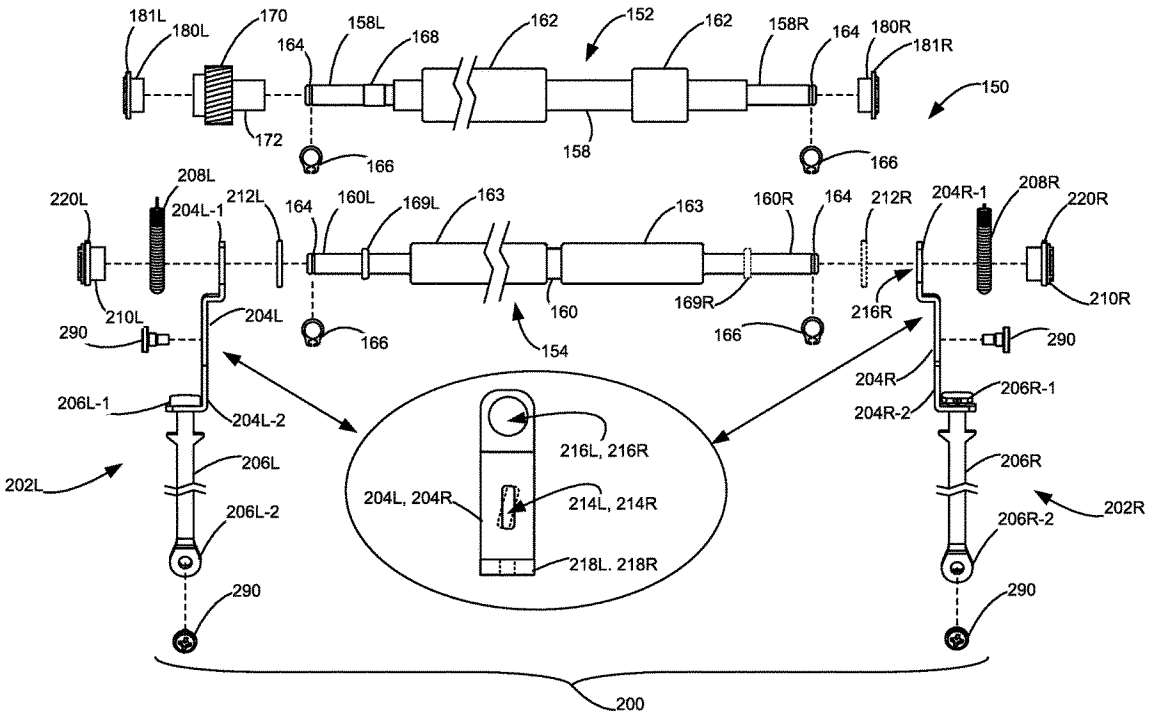
FIG. 4 is an exploded view of the door-actuated feed roll separator of the present disclosure.
Figure 6:
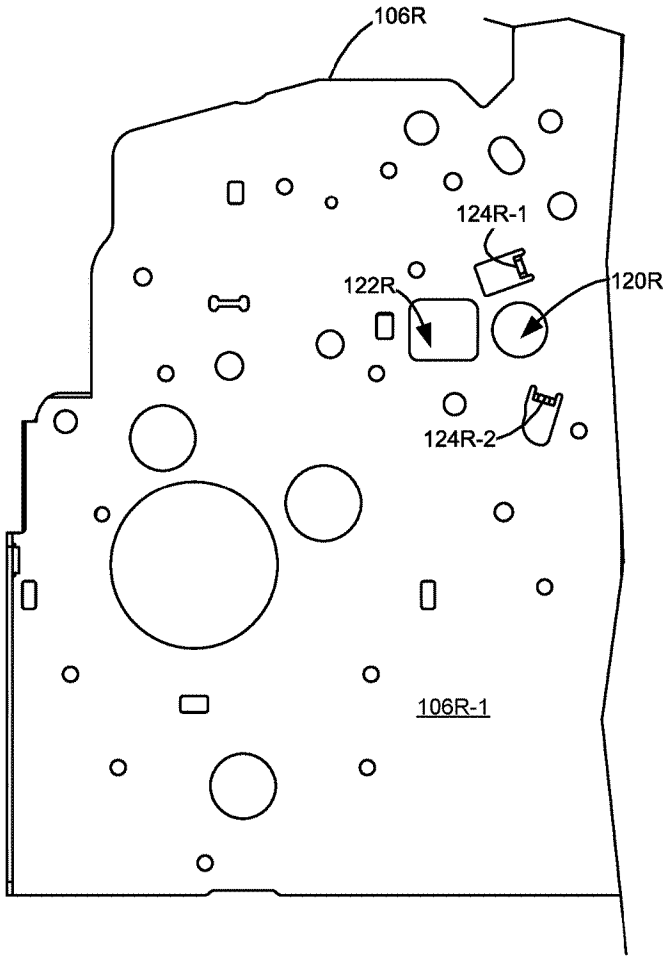
FIGS. 5-6 are elevational views of the left and right sides of the frame of FIG. 2 showing the mountings used for the door-actuated feed roll separator of FIG. 3.
Figure 5:
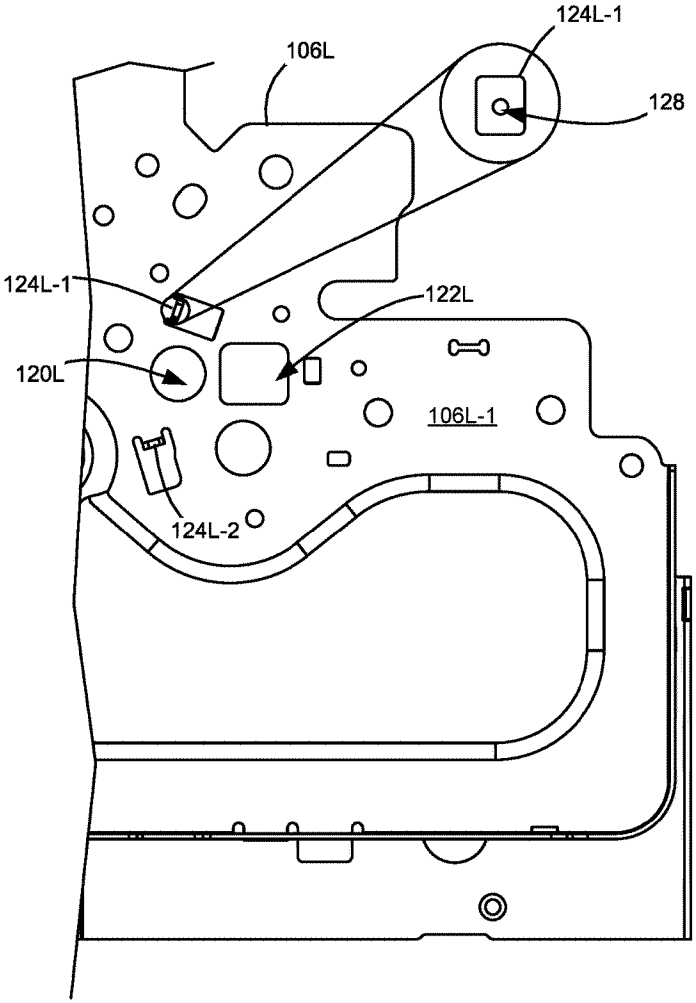

Referring to FIGS. 4-6, separator mechanism 200 and feed roll pair 150 and their respective mounting arrangements on the pair of opposed side panels 106L, 106R are illustrated. Drive roll 152 of feed roll pair 150 has a shaft 158 having channels 164 provided in the left and right ends 158L, 158R. One or more rollers 162, typically of a compliant material (such as rubber, as a nonlimiting example) are provided on shaft 158, two rollers 162 are shown. A raised portion 168 of shaft 158 is provided inboard of the left end 158L. Drive gear 170 having mounting sleeve 172 is driven over raised portion 168 securing drive gear 170 to shaft 158. Alternatively, flats may be provided in sleeve 172 and on shaft end 158L for the mounting of drive gear 170. As shown in FIGS. 5-6 a first pair of opposed openings, left and right openings 120L, 120R, is provided in left and right side panels 106L, 106R. Left and right openings 120L, 120R are sized to receive left and right opposed bushings 180L, 180R respectively. Left and right ends 158L, 158R of shaft 158 are received in respective left and right bushings 180L, 180R. C-clips 166 mount in grooves 164 outboard of left and right bushings 180L, 180R when drive roll 152 is mounted. Left and right flanges 181L, 181R on bushings 180L, 180R, respectively, have a diameter that is greater than that of opposed openings 120L, 120R so that when c-clips 166 are mounted, drive roll 152 is fixed between left and right side panels 106L, 106R.

Figure 12:
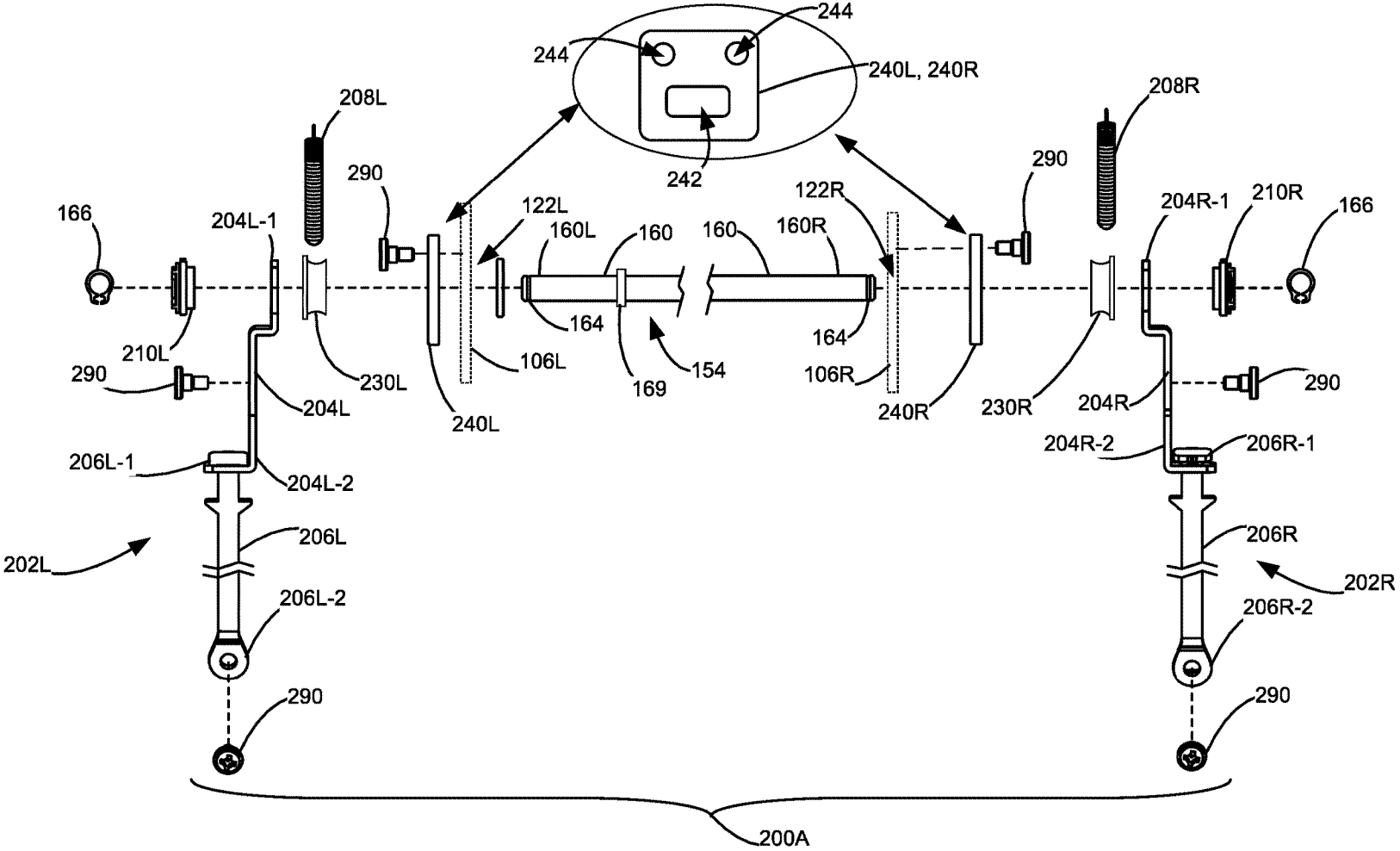
FIG. 12 is an exploded view of a first example alternate embodiment of a feed-roll separator of the present disclosure having slotted bushings for the feed rolls and bushings for the biasing springs.
Figure 13:
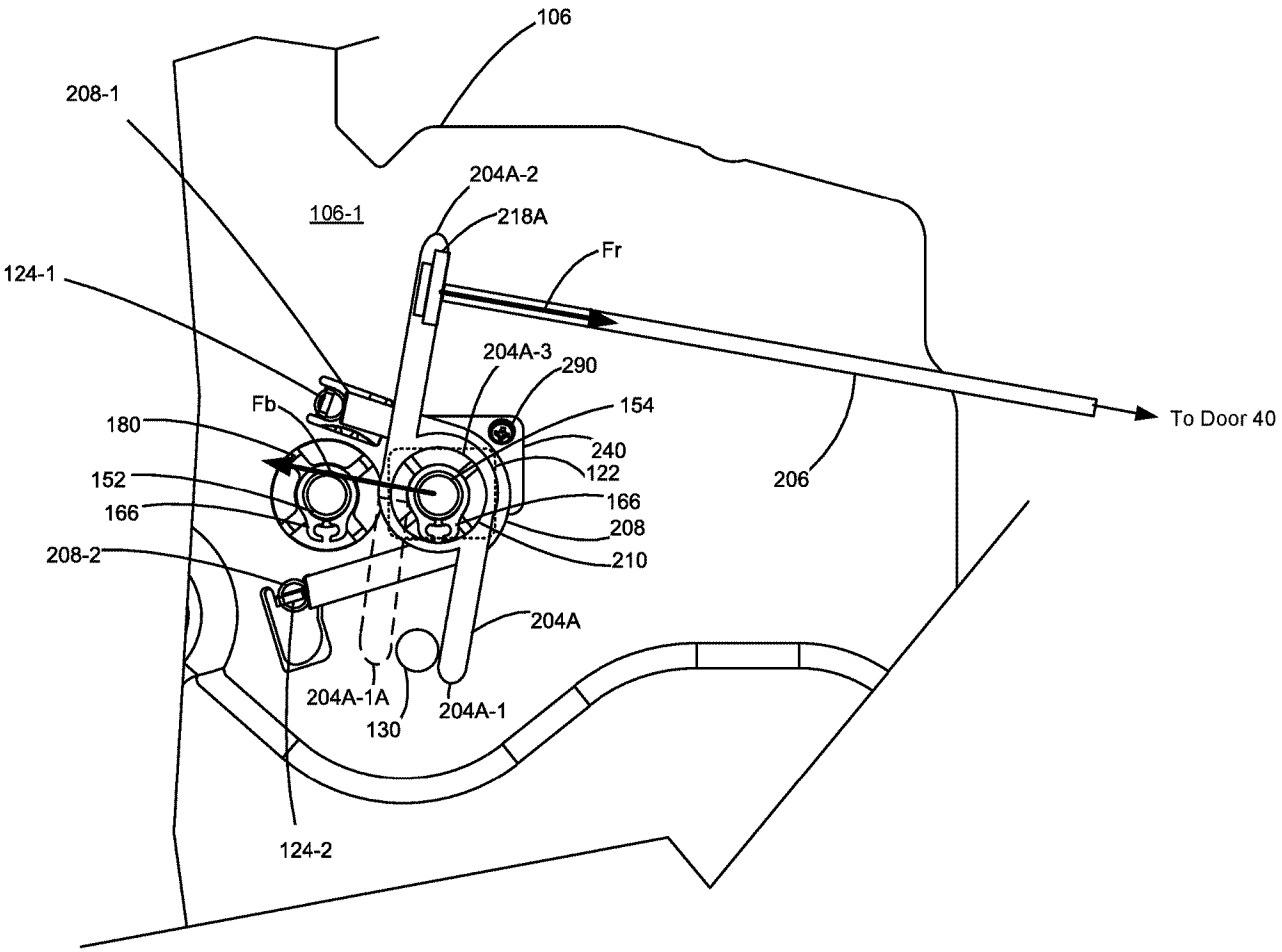
FIG. 13 is an illustration of a second example alternate embodiment of a feed-roll separator of the present disclosure wherein the release link operates as a second class lever.

Backup roll 154 of feed roll pair 150 has a shaft 160 having channels 164 provided in the left and right shaft ends 160L, 160R. Backup roll 154, as shown, is a solid steel roll having one or more expanded cylindrical portions 163, two expanded cylindrical portions 163 are shown and aligned with rollers 162 of drive roll 152. Backup roll 154 may also be constructed similarly to drive roll 152 and have compliant rollers. Feed nip 156 is formed between rollers 162 and cylindrical portions 163. Backup roll 154 is mounted at left and right shaft ends 160L, 160R to left and right release mechanisms 202L, 202R, respectively. Release mechanisms 202L, 202R are substantially identical and each comprise a link, a tether, a spring and various pieces of mounting hardware. As shown in FIGS. 5-6 a second pair of opposed openings, left and right openings 122L, 122R, is provided in left and right side panels 106L, 106R outboard of opposed openings 120L, 120R. Left and right shaft ends 160L, 160R pass through left and right openings 122L, 122R, respectively, and are received in left and right release mechanisms 202L, 202R, respectively. Openings 122L, 122R are larger than the diameter of shaft ends 160L, 160R to allow backup roll 154 to be translated during operation of separation mechanism 200. The centers of left and right openings 122L, 122R are substantially horizontally aligned with the centers of left and right openings 120L, 122R, respectively. Also as shown in FIGS. 12-13, horizontally slotted bushings 240L, 240R may be mounted across openings 122L, 122R through which the left and right ends 160L, 160R pass.

The construction of drive roll 152 and backup roll 154 is a matter of design choice and not of limitation.

Left release mechanism 202L has a link 204L having first and second ends 204L-1, 204L-2, respectively. An opening 216L (see inset in FIG. 4) is provided at first end 204L-1 and a bushing 210L is mounted therein. The left end 160L of shaft 160 is received into bushing 210L. A tether attachment 218L is provided at second end 204L-1. A slot 214L (see inset in FIG. 4) is provided in link 204L. As shown slot 214L is positioned approximately midway between first and second ends 204L-1, 204L-2 and may be parallel to the length of link 204L or as shown by the dashed line slot positioned at an angle. A fastener 290 is used to mount link 204L to an outer surface 106L-1 of left side panel 106L. A left tether 206L is attached to left tether attachment 218L and tether mount 46L on door 40. As shown, a first end 206L-1 of left tether 206L is connected to left tether attachment 218L. A fastener 290 may be used to secure the second end 206L-2 of left tether 206L to left tether mount 46L. As shown in FIG. 7, a left spring 208L, such as coil spring 208L, has first and second ends 208L-1, 208L-2 attached to upper and lower spring mounts 124L-1, 124L-2 provided on left side panel 106L and approximately aligned with the center of opening 120L. Left spring 208L is stretched to seat along a portion of the outer circumference of left bushing 210L. A flange 220L may be provided along an outer side of left bushing 210L to help seat left spring 208L. When mounted as shown in FIG. 7, left spring 208L has a C-shaped configuration and applies a biasing force to backup roll 154 to move it toward drive roll 152.

Figure 9:
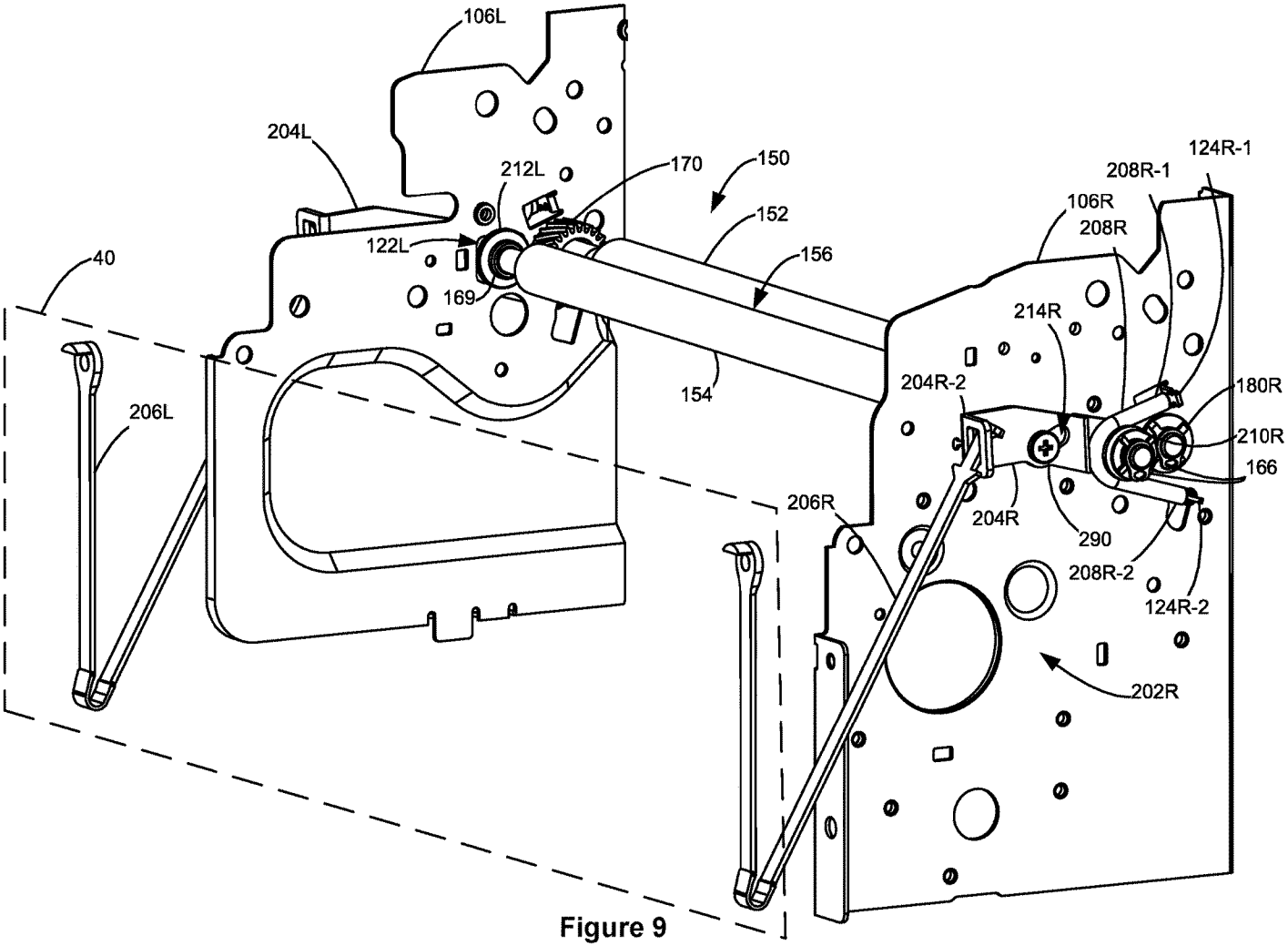
FIG. 9 is a right side perspective view for the door-actuated feed roll separator of FIG. 3 with the feed rolls in a media feeding state and the door closed.

Right release mechanism 202R has a link 204R having first and second ends 204R-1, 204R-2, respectively. An opening 216R is provided at first end 204R-1 and right bushing 210R is mounted therein. The right end 160R of shaft 160 is received into bushing 210R. A right tether attachment 218R is provided at second end 204R-1 and a slot 214R is provided in link 204R. Again, as shown in FIG. 9, a fastener 290 is used to mount link 204R to an outer surface 106R-1 of right side panel 106R. A right tether 206R is attached at its first end 206R-1 to right tether attachment 218R and at its second end 206R-2 to right tether mount 46R on door 40. A right spring 208R has first and second ends 208R-1, 208R-2 attached to upper and lower spring mounts 124R-1, 124R-2 provided on right side panel 106R and approximately aligned with the center of opening 120R. Right spring 208R is mounted to right bushing 210R in the same manner as left spring 208L is mounted to left bushing 210L. A flange 220R may be provided on right bushing 210R to help seat right spring 208R. As shown in FIG. 9, right spring 208R, when mounted, has the same a C-shaped configuration as left spring 208L and applies a biasing force to backup roll 154.

Springs 208L, 208R each provide a biasing force in the range of 5±0.5 pounds. The spring forces may be the same or different depending on the design of the feed roll pair. Springs 208L, 208R are designed to provide the biasing force needed to handle the range of media types that may be fed along media path MP in imaging device 10 while remaining less than the release force provided when door 40 is in the open position.

Collar 169L may be provided inboard of the left end 160L of shaft 160. Washer 212L may be mounted on left end 160L of shaft 160 and abut collar 169L on backup roll 154. Optionally, a second collar 169R and washer 212R may be provided on right end 160R of shaft 160. C-clips 166 mount in grooves 164 outboard of left and right bushings 210L, 210R when backup roll 154 is mounted to left and right release mechanisms 202L, 202R. When assembled, washers 212L, and if used washer 212R would be on an interior surface of left and right side panels 106L, 106R, while links 204L, 204R, springs 208L, 208R and bushings 210L, 210R, are mounted on the exterior of right and left side panels 106L, 106R, respectively.

Referring to FIGS. 7-11, operation of separator mechanism 200 is illustrated. Because the left and right release assemblies 202L, 202R are substantially identical and function substantial the same only operation of the left release assembly 202L is shown. Door 40 controls operation of both the left and right release assemblies 202L, 202R. Controller 70 is used to control rotation of feed roll pair 150. Drive motor 80 is coupled to drive gear 170 on drive roll 152 via gear train 82. Drive motor may be unidirectional or reversible. Drive motor 80 is in operative communication with controller 70 via communication link 90. Various sensors, such as a door interlock sensor 72 are in operative communication with controller 70 via a communication link 92.

Figure 10:
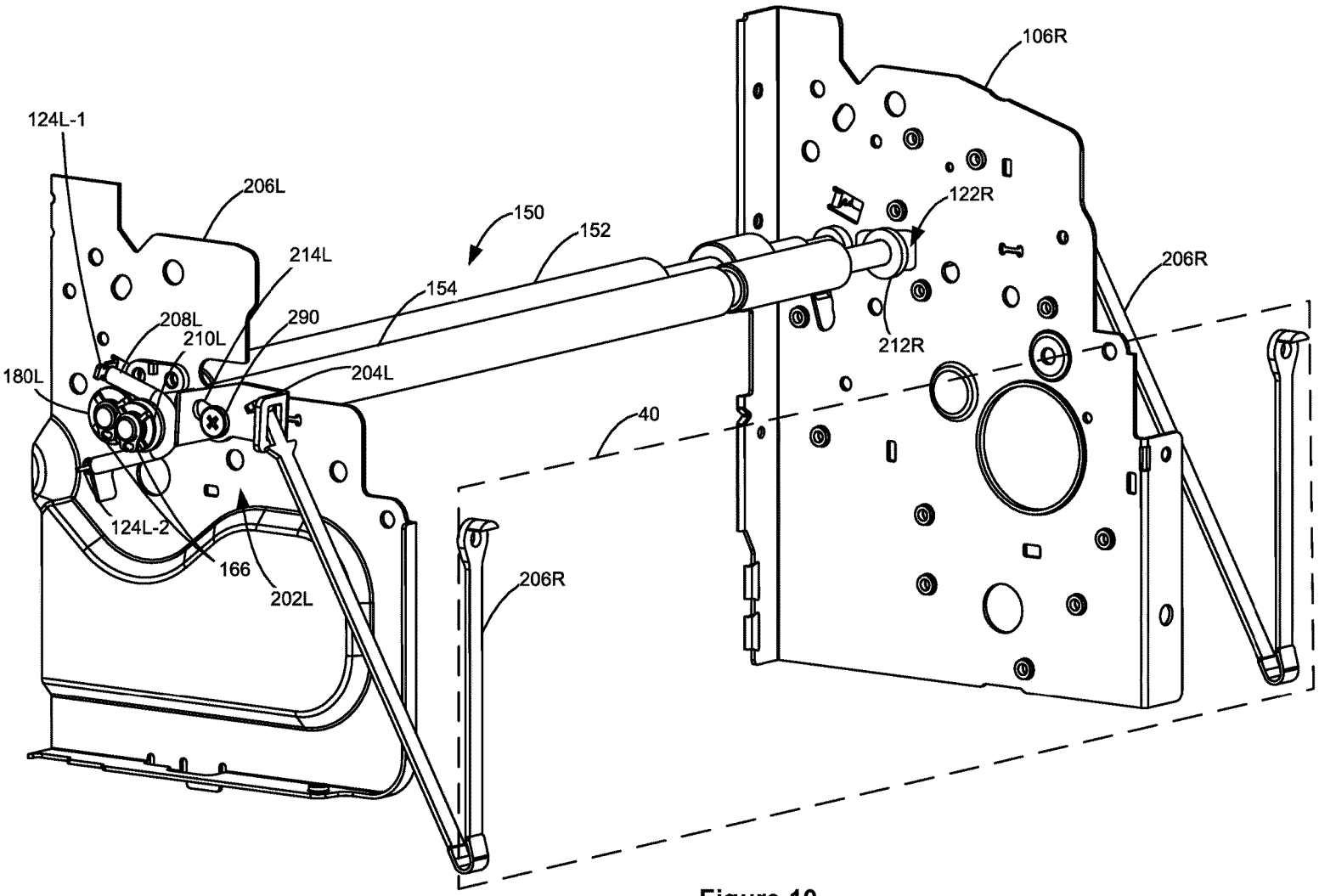
FIG. 10 is a left side perspective view for the door-actuated feed roll separator of FIG. 3 with the feed rolls in a media feeding state and the door closed.

In FIGS. 7 and 9-10, door 40 is in the raised or closed position. Interlock sensor 72 is actuated and controller 70 will permit operation of drive motor 80 to rotate drive roll 152, allowing a media sheet to be feed along the media path MP shown in FIG. 3. Tether 206L is folded and spring 208L is applying biasing forces Fb1, Fb2 to backup roll 154. With door 40 in the closed position, no release forces are provided by left and right release assemblies 202L, 202R of separation mechanism 200.

Figure 11:
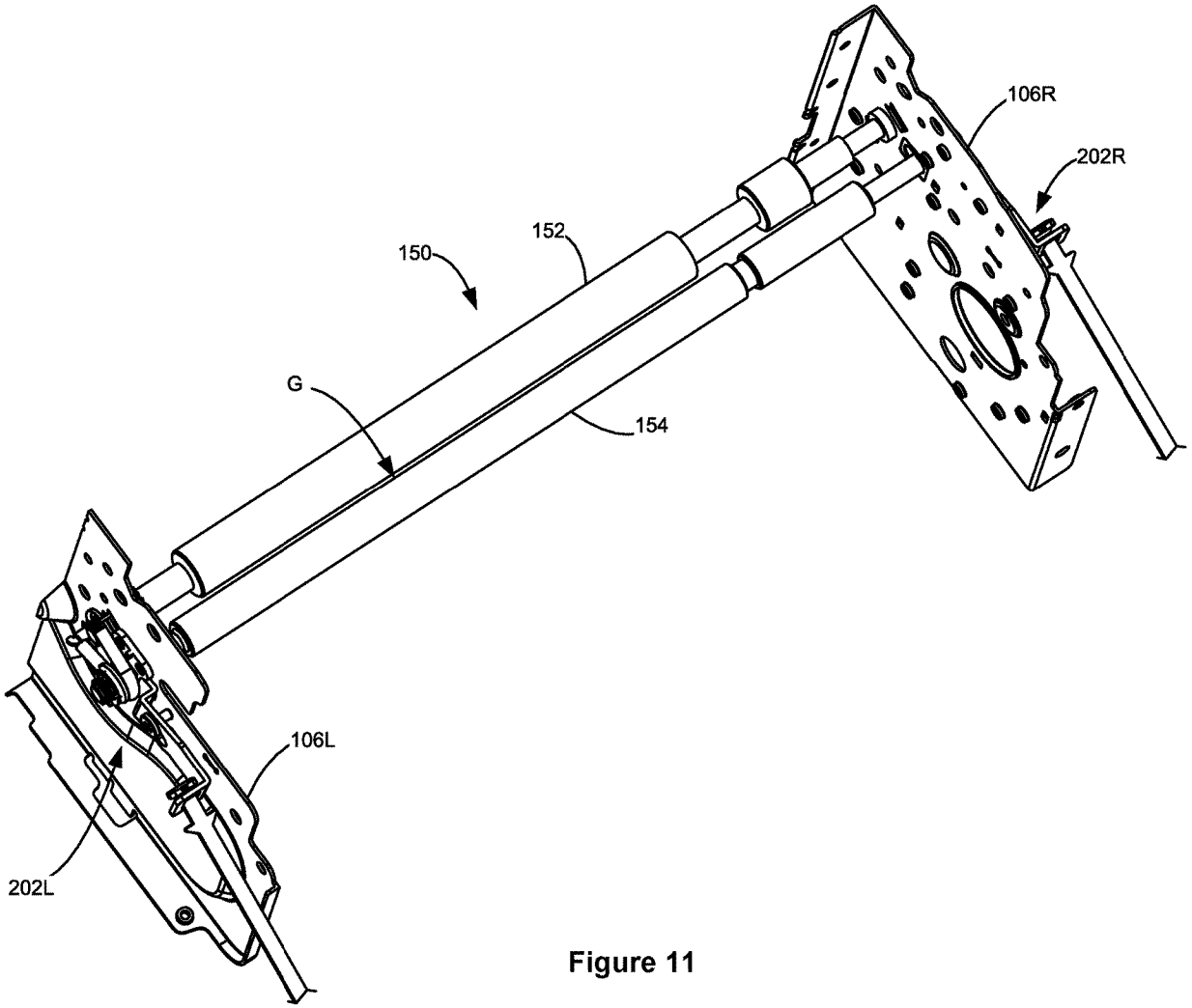
FIG. 11 is a top perspective view for the door-actuated feed roll separator of FIG. 3 with the feed rolls in a separated state.

In FIG. 8, door 40 is in the lowered or open position. Interlock sensor 72 is deactuated and controller 70 will prevent operation of drive motor 80 allowing a media sheet that may be jammed in feed roll pair 150 to be removed. Tether 206L is now extended and taut with the weight of door 40 applying a release force Fr1 to link 204L. The release force Fr1 has a magnitude that is greater than the biasing forces Fb1, Fb2. Link 204L slides along slot 214L toward door 40. This action translates backup roll 154 away from drive roll 152 creating a gap G as shown in FIG. 11 allowing a jammed media sheet to be more easily removed from feed roll pair 150. The combination of release forces of both left and right release assemblies 202L, 202R will be referred to as release force Fr and the combination of biasing forces of both left and right springs 208L, 208R, will be referred to as Fb. The total release force Fr provided by the weight of door 40 is designed to be greater than the sum of the total biasing force Fb plus any frictional forces, usually less than 0.5 pounds, resisting the motion of the release assemblies 202L, 202R. This sum of these forces is referred to as the maximum biasing force Fbmax. The total release force Fr is designed to be greater than Fbmax. The total release force Fr may for example be in the range of about 9.5 to about 11.5 pounds when the total biasing force is in the range of 4.5-5.5 pounds. The release force is greater because when the release mechanisms 202L, 202R, translate the backup roll 154 away from the drive roll 152, the two biasing springs 208L, 208R are stretched away from their respective mounts 124L-1, 124L-2 and 124R-1, 124R-2, respectively, which acts to increase the biasing force that they provide. The release force provided by left release assembly 202L may be the same as, less than or greater than the release force provided by right release assembly 202R when door 40 is lowered into its open position.

FIG. 12 illustrates separation mechanism 200A that is an alternate embodiment of separation mechanism 200. Like elements will carry the same or similar reference numbers. For brevity only changes between the two mechanisms will be described in that each separation mechanism works in substantially the same manner. Separation mechanism 200A includes separate right and left spring bushings 230L, 230R that are mounted on left and right shaft ends 160L, 160R, respectively, and are used for the mounting of left and right biasing springs 208L, 208R, respectively. Spring bushings 230L, 230R are shown mounted inboard of their respective links 204L, 204R. Left and right bushings 210L, 210R, are mounted in corresponding openings at the first ends 204L-1, 204R-1 of left and right links 204L, 204R, respectively. In addition, left and right slotted bushings 240L, 240R are mounted to left and right side panels 106L, 106R by fasteners 290 over left and right opposed openings 122L, 122R. As shown in the inset, the left and right slotted bushings 240L, 240R are illustrated as having two mounting holes 244 and a horizontal slot 242. Right and left shaft ends 160L, 160R of backup roll 154 are received in respective slots 242 in the right and left slotted bushings 240L, 240R.

FIG. 13 illustrates an alternate embodiment of link 204 that may be used in separation mechanism 200 or 200A. In FIG. 13 link 204A is shown in use with separation mechanism 200A. Link 204A has a first arm 204-A1 and a second arm 204A-2 extending outward from a center opening 204A-3 which is sized to be received on an end of backup roll 154. First and second arms 204A-1, 204A-2 of link 204A may be offset and parallel as shown but may also be aligned with each other as indicated by the dotted line arm 204A-1A. Link 204A is mounted on an end of backup roll 154 rather than on side panel 106. Link 204A is mounted on backup roll 154 between bushing 210 and slotted bushing 240 on the outer surface 106-1 of side panel 106. A distal end of first arm 204A-1 is adjacent to a post 130 provided on the outer surface 106-1 of side panel 106 inboard of link 204A. A tether attachment 218A is provided at a distal end of second arm 204A-2 to which one end of tether 206 is attached. The other end of tether 206 is attached to door 40 as previously described.

As arranged in FIG. 13 link 204A acts as a second class lever. When door 40 is lowered to an open position, a release force Fr is applied to the distal end of second arm 204A-2 rotating link 204A about backup roll 154 to counteract the biasing force Fb provided by spring 208. The distal end of first arm 204A-1 contacts post 130 which acts as a fulcrum and increases the mechanical advantage of the release force Fr in translating backup roll 154 in slotted bushing 120 and opening the feed nip between the drive roll 152 and the backup roll 154. By arranging link 204A to act as a lever, a lighter door may be used to provide the release force Fr needed to overcome the biasing force Fb of the two springs 180L, 180R. One or both links in separation mechanisms 200, 200A may be replaced by link 204A together with post 130.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. An imaging device having a media path within the imaging device, the imaging device comprising:

a frame having a pair of opposed panels spaced apart and having a media path therebetween;

a door pivotally mounted along a bottom edge thereof to the frame about a pivot axis, the door having a raised closed position and a lowered open position, the door substantially covering the media path between the pair of opposed panels when in the closed position;

a feed roll pair mounted across the media path and between the pair of opposed panels, the feed roll pair having a drive roll and a backup roll forming a feed nip therebetween, the drive roll rotatably mounted to the pair of opposed panels, and, the backup roll rotatably mounted to a separator mechanism and translatable with respect to the pair of opposed panels and the drive roll; and, the separator mechanism having a pair of opposed release assemblies coupled to respective ends of the backup roll being rotatably mounted to the pair of opposed release assemblies, each release assembly having:

a link having an opening for receiving a respective end of the backup roll;

a tether having a first end connected to the link and a second end connected to the door at a predetermined distance from the pivot axis of the door; and, a biasing member mounted to a respective one of the pair of opposed panels wherein the biasing member applies a biasing force to a respective end of the backup roll pressing the backup roll into contact with the drive roll forming the feed nip, wherein, with the door lowered to an open position, the weight of the door applies a release force to each of the respective links, via the respective tethers, translating and separating the backup roll from the drive roll, and further wherein, with the door in a raised closed position, the tethers are folded and no release force is applied by the door to the respective link.

2. The imaging device of claim 1 wherein, at least one of the links of the pair of opposed release assemblies is slidably attached to a respective one of the pair of opposed panels with the link having a first end having the opening for receiving a respective end of the backup roll and a second end having an attachment for the first end of the tether.

3. The imaging device of claim 2 wherein, a bushing is mounted in the opening in the first end of the link.

4. The imaging device of claim 1 wherein, at least one of the links has center opening sized to be rotatably received on a respective end of the backup roll with a first and second arm extending away from the center opening with a distal end of the first arm positioned adjacent to a post mounted on the respective panel and a distal end of the second arm having an attachment for an end of the tether wherein with the door in an open position, the link acts as a second class lever and the post acts as a fulcrum for the link.

5. The imaging device of claim 4 wherein, a bushing is mounted in the center opening of the link.

6. The imaging device of claim 1 wherein:

the pair of opposed panels has a pair of opposed openings, each opening of the pair of opposed openings being sized to allow backup roll to be translated therein; and, a pair of opposed bushings respectively mounted to the pair of opposed panels and positioned over respective openings in the pair of opposed openings with each bushing have a horizontal slot sized to receive a respective end of the backup roll allowing the backup roll to be translated toward and away from the drive roll.

7. The imaging device of claim 1 wherein a pair of opposed bushings are mounted on respective ends of the backup roll and the biasing member is a coil spring mounted in a C-configuration to an outer surface of each panel of the pair of opposed panels with a portion of the coil spring wrapped around a respective portion of the respective bushing of the pair of opposed bushings.

8. An imaging device having a media path within the imaging device, the imaging device comprising:

a frame having a pair of opposed panels spaced apart and having a media path therebetween;

a door pivotally mounted along a bottom edge thereof to the frame, the door having a raised closed position and a lowered open position, the door substantially covering the media path between the pair of opposed panels when in the closed position;

a feed roll pair mounted across the media path and between the pair of opposed panels, the feed roll pair having a drive roll and a backup roll forming a feed nip therebetween, the drive roll rotatably mounted to the pair of opposed panels, and, the backup roll rotatably mounted to a separator mechanism; and, the separator mechanism having a pair of opposed release assemblies coupled to a respective panel of the pair of opposed panels with respective ends of the backup roll being rotatably mounted to the pair of opposed release assemblies, each release assembly having:

a link slidably attached to a respective one of the pair of opposed panels, the link having a first end and a second end, the first end of the link having an aperture for receiving a respective end of the backup roll;

a tether having a first end connected between the second end of the link and a second end connected to the door at a predetermined distance from a pivot axis of the door; and, a biasing member mounted to a respective one of the pair of opposed panels wherein the biasing member applies a biasing force to a respective end of the backup roll pressing the backup roll into contact with the drive roll forming the feed nip, wherein, with the door lowered to an open position, the weight of the door applies a release force to each of the respective links, via the respective tethers, translating and separating the backup roll from the drive roll, and further wherein, with the door in a raised closed position, the respective tethers are folded and no release force is applied by the door to the respective links.

9. The imaging device of claim 8 wherein:

the pair of opposed panels has a first pair and a second pair of opposed openings, each opening of the second pair of opposed openings being substantially horizontally aligned with a respective one opening of the first pair of opposed openings, each opening of the first pair of opposed openings having a bushing mounted therein with a respective end of the backup roll mounted in the bushing with each opening of the second pair of opposed openings being sized to allow backup roll to be translated therein; and, each link being slidably mounted on an outer surface of each respective panel in the pair of opposed panels with the aperture at a first end thereof having a bushing mounted therein with a respective end of the backup roll received in the bushing.

10. The imaging device of claim 9 wherein, a pair of opposed bushings is respectively mounted to the pair of opposed panels and positioned over respective openings in the second pair of opposed openings with each bushing having a horizontal slot sized to receive a respective end of the backup roll allowing the backup roll to be translated toward and away from the drive roll.

11. The imaging device of claim 9 wherein, the biasing member is a coil spring mounted in a C-configuration to an outer surface of each panel of the pair of opposed panels with a portion of the coil spring wrapped around a portion of the bushing mounted in each link.

12. The imaging device of claim 11 wherein, each bushing mounted in each link has an outer circumferential flange.

13. The imaging device of claim 8 wherein, both of the biasing members provide a total biasing force in the range of about 4.5 pounds to about 5.5 pounds.

14. The imaging device of claim 13 wherein, the door provides a release force in the range of about 9.5 pounds to about 11.5 pounds.

15. An imaging device comprising:

a frame having a pair of opposed panels, the pair of opposed panels having a first and a second pair of opposed openings, the pair of opposed panels positioned parallel to a media path and having mounted thereto a feed roll pair for transporting a media sheet along the media path;

a door pivotally mounted along a bottom edge thereof to the frame, the door having a raised closed position and a lowered open position, the door having a pair of opposed tether mounts provided on an inner surface thereof adjacent to a respective left and a respective right edge of the door and at a predetermined distance from a pivot axis of the door, the door substantially covering the media path between the pair of opposed panels when in the closed position;

the feed roll pair having a drive roll and a backup roll forming a feed nip therebetween, the ends of the drive roll being rotatably and fixedly mounted in a pair of opposed bushings mounted in the first pair of opposed openings with the ends of the backup roll extending through the second pair of opposed openings and being rotatably and fixedly mounted to a separator mechanism; and the separator mechanism having a pair of opposed release assemblies mounted on respective exterior surfaces of the pair of opposed panels, the pair of opposed release assemblies each having:

a link slidably attached to a respective one of the pair of opposed panels, each link having a first end and a second end, the first end of the link having a bushing mounted therein for receiving a respective end of the backup roll;

a foldable tether connected between the second end of a respective link and a respective one of the pair of opposed tether mounts;

a spring bushing mounted on respective end of the backup roll; and a spring wrapped around a portion of an outer circumference of the spring bushing, the springs of the pair of opposed release assemblies applying respective biasing forces to the respective ends of the backup roll to press the backup roll into contact with the drive roll forming the feed nip, wherein, with the door lowered to an open position, the weight of the door applies a release force to the pair of opposed release assemblies via the respective tethers, sliding the links of the pair of opposed release assemblies and separating the backup roll from the drive roll with the respective ends of the backup roll moveable within the second pair of opposed openings without contacting a respective inner wall thereof, and further wherein, with the door in a raised closed position, the respective tethers are folded and no release force is applied by the door to the respective links.

16. The imaging device of claim 15 wherein, the spring is a coil spring mounted in a C-configuration to an outer surface of each panel of the pair of opposed panels.

17. The imaging device of claim 15 wherein:

each opening of the second pair of opposed openings is substantially horizontally aligned with a respective one opening of the first pair of opposed openings and sized to allow the backup roll to be translated therein.

18. The imaging device of claim 17 wherein, a pair of opposed bushings is respectively mounted to the pair of opposed panels and positioned over respective openings in the second pair of opposed openings with each bushing have a horizontal slot sized to receive a respective end of the backup roll allowing the backup roll to be translated toward and away from the drive roll.

19. The imaging device of claim 15 wherein, the two springs provide a total biasing force in the range of about 4.5 pounds to about 5.5 pounds.

20. The imaging device of claim 19 wherein, the door provides a release force in the range of about 9.5 pounds to about 11.5 pounds.

21. The imaging device of claim 15 further comprising:

a controller;

a drive motor in operative communication with the controller;

a door interlock sensor in operative communication with the controller, the door interlock sensor being actuated when the door is in the closed position and deactuated when the door is in an open position;

a gear train coupled to the drive motor; and, a drive gear mounted on the drive roll and coupled to the gear train, wherein, with the door in a closed position and the door interlock sensor actuated, the controller is operable to activate the drive motor to drive the drive roll for feeding a media sheet along the media path, and, with the door in an open position and the door interlock sensor deactuated, the controller deactivates the drive motor with the left and right release assemblies translating the backup roll away from the drive roll.

22. An imaging device having a media path within the imaging device, the imaging device comprising:

a frame having a pair of opposed panels spaced apart and having a media path therebetween, the pair of opposed panels having a first pair and a second pair of opposed openings, each opening of the second pair of opposed openings being substantially horizontally aligned with a respective one opening of the first pair of opposed openings, each opening of the first pair of opposed openings having a bushing mounted therein with a respective end of a backup roll mounted in the bushing with each opening of the second pair of opposed openings being sized to allow the backup roll to be translated therein;

a door pivotally mounted along a bottom edge thereof to the frame, the door having a raised closed position and a lowered open position, the door substantially covering the media path between the pair of opposed panels when in the closed position;

a feed roll pair mounted across the media path and between the pair of opposed panels, the feed roll pair having a drive roll and the backup roll forming a feed nip therebetween, the drive roll rotatably mounted to the pair of opposed panels, and, the backup roll rotatably mounted to a separator mechanism; and, the separator mechanism having a pair of opposed release assemblies coupled to a respective panel of the pair of opposed panels with respective ends of the backup roll being rotatably mounted to the pair of opposed release assemblies, each release assembly having:

a link slidably attached to a respective one of the pair of opposed panels, the link having a first end and a second end, the first end of the link having an aperture for receiving a respective end of the backup roll, each link being slidably mounted on an outer surface of each respective panel in the pair of opposed panels with the aperture at a first end thereof having a bushing having an outer circumferential flange and mounted therein with a respective end of the backup roll received in the bushing;

a tether having a first end connected between the second end of the link and a second end connected to the door at a predetermined distance from a pivot axis of the door; and, a coil spring biasing mounted in a C-configuration to an outer surface of each panel of the pair of opposed panels with a portion of the coil spring wrapped around a portion of the bushing mounted in each link member mounted to a respective one of the pair of opposed panels wherein the coil spring applies a biasing force to a respective end of the backup roll pressing the backup roll into contact with the drive roll forming the feed nip, wherein, with the door lowered to an open position, the weight of the door applies a release force to each of the respective links, via the respective tethers, translating and separating the backup roll from the drive roll.

* * * * *